United States Patent [19]

Widemann et al.

[11] 4,246,562

[45] * Jan. 20, 1981

[54] COIL FORM

[75] Inventors: Rudolf Widemann, Neubiberg; Roland Ehrgott, Munich, both of Fed. Rep. of Germany

[73] Assignee: Siemens Aktiengesellschaft, Berlin & Munich, Fed. Rep. of Germany

[ * ] Notice: The portion of the term of this patent subsequent to May 30, 1995, has been disclaimed.

[21] Appl. No.: 941,311

[22] Filed: Sep. 11, 1978

[30] Foreign Application Priority Data

Sep. 15, 1977 [DE] Fed. Rep. of Germany ..... 2741608
Sep. 15, 1977 [DE] Fed. Rep. of Germany ... 7728572[U]

[51] Int. Cl.[3] ..... H01F 15/10

[52] U.S. Cl. ..... 336/192; 336/65; 339/220 R

[58] Field of Search ..... 310/71; 339/217 S, 220 R, 339/220 C, 220 T, 221 R, 221 M; 336/192, 65, 198, 208

[56] References Cited

U.S. PATENT DOCUMENTS

| | | | |
|---|---|---|---|
| 2,339,054 | 1/1944 | Craddock et al. | 336/192 |
| 2,649,558 | 8/1953 | Franz | 336/192 |
| 2,807,790 | 9/1957 | Del Camp | 339/220 T |
| 2,922,932 | 1/1960 | Glowacki et al. | 336/192 X |
| 3,189,857 | 6/1965 | Jones | 336/192 X |
| 3,270,311 | 8/1966 | Deer et al. | 339/17 M |
| 3,566,322 | 2/1971 | Horbach | 336/198 X |
| 3,699,505 | 10/1972 | Bruner | 339/221 R |
| 4,003,128 | 1/1977 | Dochterman | 336/192 |
| 4,092,622 | 5/1978 | Widemann et al. | 336/192 |

*Primary Examiner*—Thomas J. Kozma
*Attorney, Agent, or Firm*—Hill, Van Santen, Steadman, Chiara & Simpson

[57] ABSTRACT

A coil form or body for coils is disclosed particularly for use in printed circuits. The coil form has a flange provided with insertable perforations in order to accommodate one-piece soldering lugs having soldering lug legs aligned at a right angle relative to one another in order to solder the coil wires and particularly for soldering into the printed circuit. The soldering lugs are equipped with at least one clamping element which abuts against the surface of the coil member flange when the soldering lug is pushed in and secures the coil form from shifting. The perforations are designed at a right angle and at least one latch is arranged on at least one soldering lug leg. This latch abuts against the exterior side of the flange when the soldering lug is inserted into the perforation.

3 Claims, 3 Drawing Figures

COIL FORM

BACKGROUND OF THE INVENTION

The invention relates to a coil body or form for coils, particularly for printed circuits, having a coil body flange provided with push-in type perforations in order to accommodate soldering lugs of one-piece design with soldering lug shanks or legs aligned at a right angle relative to one another in order to solder the coil wires, and for soldering into the printed circuit. The soldering lugs are equipped with at least one clamping portion which abuts against the surface of a face of the coil body flange when the soldering lug is securely pushed in.

Printed circuits require a separate arrangement of the electrical components in order to utilize space as much as possible. Such arrangements, however, depend upon a limitation of reciprocal magnetic influences, i.e. by a vertical or parallel alignment of the magnetic axes of electric coils, chokes, and other radiators relative to the printed circuit board.

SUMMARY OF THE INVENTION

It is an object of the present invention to provide a coil body or form for the electric components mentioned above, the design and soldering lugs of which are fashioned such that the layout requirements can be fulfilled without considerable expense and that the soldering lugs can be assembled without great effort.

In order to resolve this objective in a coil body or form of the initially mentioned type, the invention provides that the perforations in the aforementioned coil bodies are designed at a right angle and that at least one detent or latch is arranged at least on one soldering lug leg or shank, and that the detent abuts against the exterior side of the flange when the soldering lug is pushed into the perforation.

A tight fit in the coil member perforation and a safeguard against pushing-out of the soldering lugs is additionally obtained in that the soldering lug shanks are provided with latches and, if necessary, additionally provided with saw-tooth-like strips. Also the solder lugs can have a slightly greater dimension than the perforations in the coil form flange. Therefore the synthetic material of the coil body or form is displaced due to its springy properties and/or flow properties. In the final position of the soldering lug shank rigidly projecting teeth are buried into the synthetic material or the latch of the soldering lug shank or leg is hooked behind the sprung-back synthetic material edge of the coil form. A scraping-off of the synthetic material surface would occur in the perforation when the soldering lug leg is pushed out, and consequently the forces occurring with the soldering-on of wire strand ends and with the mounting of the coil body in a printed circuit board are not sufficient to push the shank out.

The soldering lugs can be pushed into the perforations designed into the coil member flanges without the use of a special tool, and the latches and the saw-tooth-like strips guarantee a satisfactory fit of the soldering lugs in their final position which is safeguarded against displacement. Additional mounting means such as, for example, adhesive material or a subsequent treatment of the coil member are not required.

DESCRIPTION OF THE PREFERRED EMBODIMENT

Figure 1:
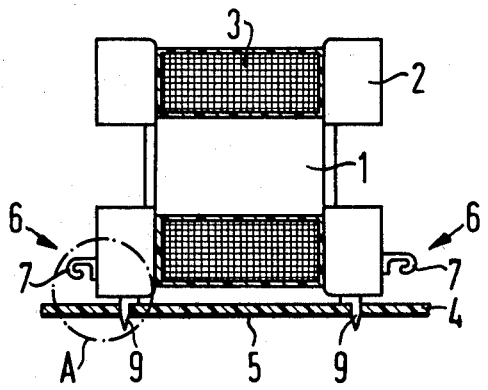
FIG. 1 illustrates in a schematic and partially sectional illustration a side view of a coil mounted on a printed circuit board with a coil form in accordance with the invention having its longitudinal center axis parallel to the printed circuit board.
Figure 3:
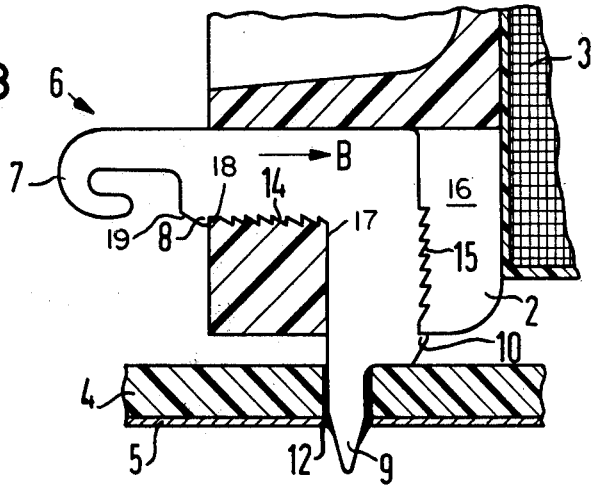
FIG. 3 shows a second embodiment of the invention in the illustration in accordance with FIG. 2.
Figure 2:
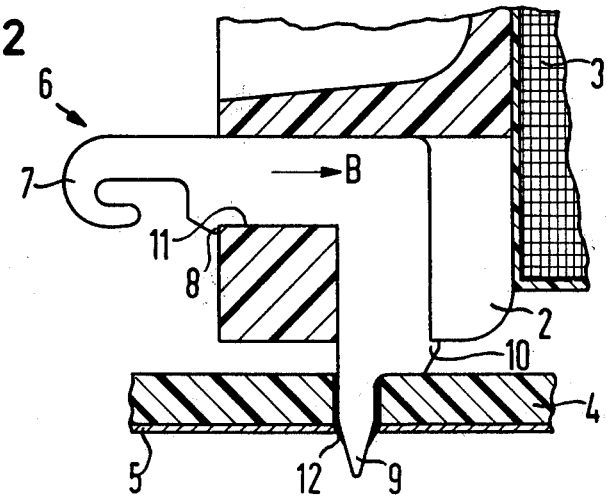
FIG. 2 illustrates in enlarged scale detail A in accordance with FIG. 1 in sectional and partially broken illustration.

According to FIG. 1, a coil form or body 1 has a coil body flange 2 wound with a winding 3, said flange being equipped with soldering lugs 6 having pin-shaped ends 7 or 9, respectively. In all embodiments shown, the pin-like ends 9 are vertically aligned relative to the longitudinal center or magnetic axis of the coil and, as indicated at 12 in FIGS. 2 and 3, are attached by means of soldering in perforations of a printed circuit board 4 covered with metallic conductor paths 5. The coil body flanges 2 have push-in type or slot-shaped rectangular perforations 11 of an L-shape with a right-angle portion 17 into which the soldering lugs are advantageously inserted through insertion slot 16 without spring. The soldering lug shanks or legs equipped with pin and soldering lug-shaped ends are designed with rigid latches 8 or 10, having a beveled surface 19 and right angle abutment surface 18 respectively, in the embodiment in accordance with FIGS. 1 and 2. These latches are of integral construction with the soldering lug legs. Depending upon the insert direction, the latch 8 or 10 abuts against the exterior side of the flange and thus secures the soldering lug against shifting for example, in arrow direction B.

In the embodiment in accordance with FIG. 3, in which the same components are referenced with the same symbols, the latches 8 or 10 are respectively supplemented with a saw-tooth-like strip 14 or 15 respectively fashioned at one side of each of the soldering lug legs.

The soldering lugs, advantageously punched from sheet metal as one integral piece, have soldering lug legs advantageously exhibiting a small over dimension with respect to the perforations 11 in the coil body flange 2, so that a tight fit is guaranteed in the coil body or so that a safeguard against removal of the soldering lug is guaranteed.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A printed circuit board coil form, comprising:

(a) form means for receiving a coil therearound;

(b) a flange connected to the form means;

(c) an L-shaped rectangular cross-section perforation channel at an edge of said flange, said channel having a right angle portion therein, an insertion slot providing an insertion entrance into the channel, and being formed of deformable material;

(d) a flat L-shaped pre-formed one-piece rectangular cross-section soldering lug mounted in said perforation channel, said soldering lug having a first leg electrically connecting to the coil and a second leg as a terminal at a right angle to the first leg;

(e) at least one of the first and second legs having an integral rigid non-springy latch forming an abutment surface at right angles to a longitudinal axis of the leg and a slanted surface slanted in a direction to facilitate insertion of the leg with the latch in a direction from the channel interior through one leg of the channel towards the exterior by deforming the channel material with the slanted surface until the latch abutment surface latches to an exterior surface of the flange, said latch being positioned so that the right angle of the soldering lug abuts against the channel right angle portion.

2. The coil form of claim 1 wherein both legs have one of said latches.

3. The coil form of claim 1 wherein at least one of the legs have saw-tooth like teeth means for grabbing the deformable material of the channel.

* * * * *